US008229317B2

(12) United States Patent
Xu et al.

(10) Patent No.: US 8,229,317 B2
(45) Date of Patent: Jul. 24, 2012

(54) DEVELOPING UNIT AND SIDE SEAL MEMBER

(75) Inventors: Fan Xu, Nagoya (JP); Mitsuru Horinoe, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 565 days.

(21) Appl. No.: 12/412,817

(22) Filed: Mar. 27, 2009

(65) Prior Publication Data

US 2009/0274482 A1 Nov. 5, 2009

(30) Foreign Application Priority Data

Apr. 30, 2008 (JP) ..... 2008-118384

(51) Int. Cl.
*G03G 21/10* (2006.01)
*G03G 15/08* (2006.01)

(52) U.S. Cl. ..... 399/105; 399/102; 399/111; 399/120

(58) Field of Classification Search ..... 399/111, 399/119, 120, 102–106
See application file for complete search history.

(56) References Cited

U.S. PATENT DOCUMENTS

| | | | | |
|---|---|---|---|---|
| 5,057,868 | A * | 10/1991 | Sekino et al. | 399/105 |
| 6,336,014 | B1 | 1/2002 | Sato et al. | |
| 2002/0141777 | A1* | 10/2002 | Kamimura et al. | 399/103 |
| 2007/0071489 | A1 | 3/2007 | Nakaya et al. | |
| 2007/0071490 | A1* | 3/2007 | Nakaya et al. | 399/103 |
| 2007/0140729 | A1* | 6/2007 | Carter et al. | 399/103 |

FOREIGN PATENT DOCUMENTS

| | | |
|---|---|---|
| JP | 08-076593 | 3/1996 |
| JP | 2001-022179 | 1/2001 |
| JP | 2005-215439 | 8/2005 |
| JP | 2007-093951 | 4/2007 |

* cited by examiner

*Primary Examiner* — David Porta
*Assistant Examiner* — Jessica L Eley
(74) *Attorney, Agent, or Firm* — Banner & Witcoff, Ltd.

(57) ABSTRACT

A developing unit is provided, which includes: a developer carrier; a housing; and a side sealing member disposed between an end part of the developer carrier and a portion of the housing adjacent to a supply port. The side sealing member includes an elastic member having an integral base part attached to the portion of the housing and plural integral projections protruding from the base part toward the developer carrier in a protruding direction. A distal end part of each of the projection has an inclination face inclined so that a part of the inclination face is closer to the supply port as the part of the inclination face is farther from the base part in the protruding direction.

6 Claims, 8 Drawing Sheets

FIG. 3(a)

DEVELOPING UNIT AND SIDE SEAL MEMBER

CROSS REFERENCE TO RELATED APPLICATION

The present disclosure relates to the subject matter contained in Japanese patent application No. 2008-118384 filed on Apr. 30, 2008, which is expressly incorporated herein by reference in its entirety.

TECHNICAL FIELD

The present invention relates to a developing unit provided with a side sealing member that seals between an end part of a developing roller and a developing unit housing.

BACKGROUND ART

Japanese patent publication 2007-93951A (US2007/071489A1) discloses a side seal member that is provided between an end part of a rotatable developing roller and a developing unit housing and that is located adjacent to a developer supply port of the developing unit housing. The side sealing member includes an upstream side seal and a downstream side seal, each being constructed by a two-layered configuration having a sponge base and a felt member on the sponge base.

Because fibers of the felt member are not unidirectional, developer entering the felt member may be moved in a direction away from the supply port by sliding contact between the felt member and the developing roller to cause toner leakage. Because a double-side adhesive tape is used to adhere the sponge base and the felt member together to form each of the seals and thereafter the seals are adhered to the developing unit housing, the attachment of the seals to the developing unit housing is troublesome and time-consuming.

SUMMARY

The present invention was made in view of the above-noted and/or other circumstances.

As one of illustrative, non-limiting embodiments, the present invention can provide a developing unit including: a developer carrier; a housing; and a side sealing member disposed between an end part of the developer carrier and a portion of the housing adjacent to a supply port. The side sealing member includes an elastic member having an integral base part attached to the portion of the housing and plural integral projections protruding from the base part toward the developer carrier in a protruding direction. A distal end part of each of the projection has an inclination face inclined so that a part of the inclination face is closer to the supply port as the part of the inclination face is farther from the base part in the protruding direction.

Accordingly, as one of advantages, the present invention can provide a developing unit capable of preventing developer from leaking. As another one of the advantage, the present invention can provide a developing unit capable of facilitating an attaching work of a side sealing member. These and other advantages of the present invention will be described in detail with reference to the accompanying drawings.

DESCRIPTION OF THE PREFERRED EMBODIMENT

Figure 1:
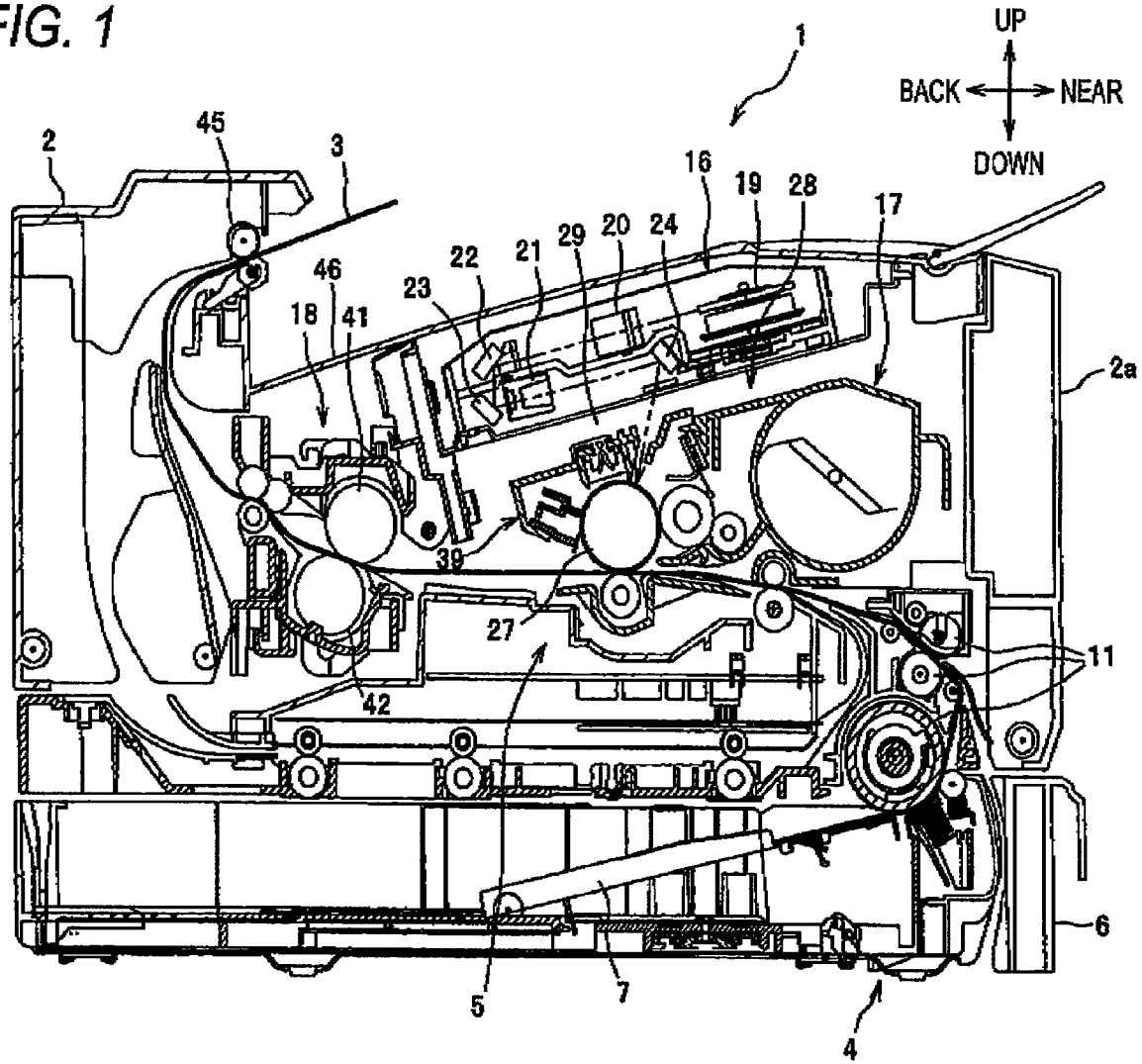
FIG. 1 is a side sectional view showing a laser printer having a development cartridge.
Figure 2:
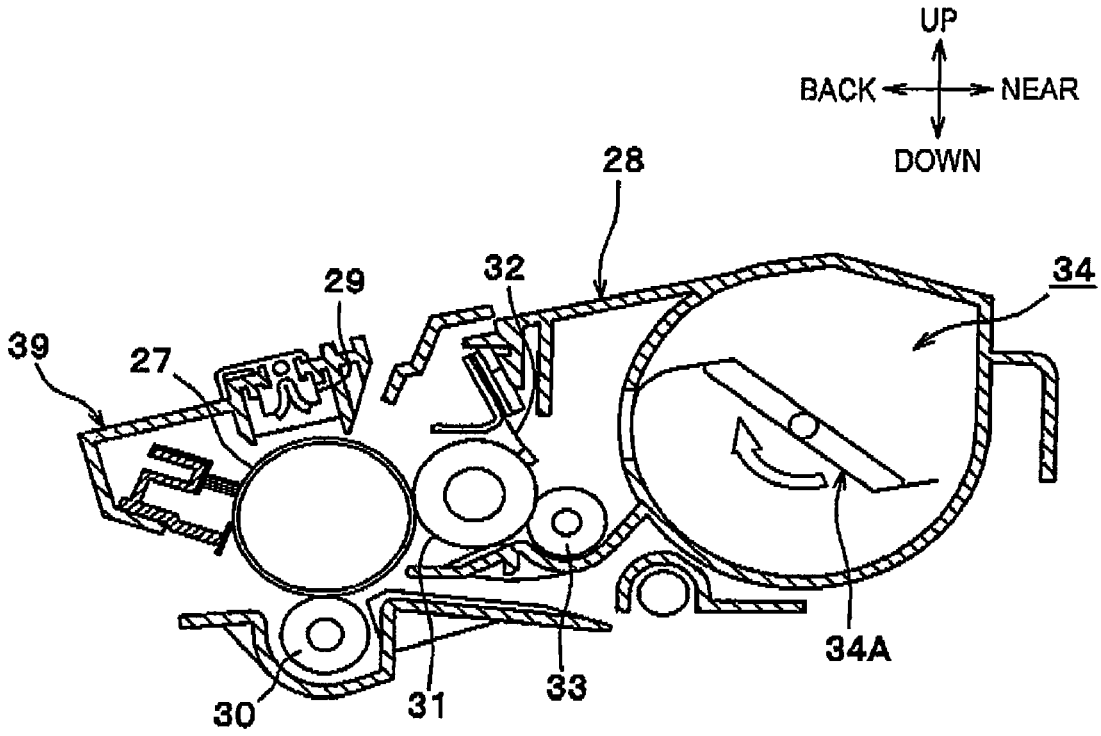
FIG. 2 is a side sectional view showing the development cartridge.

A detailed description is given of an exemplary embodiment with reference to the drawings. FIG. 1 is a side sectional view showing a laser printer provided with a development cartridge, and FIG. 2 is a side sectional view showing the development cartridge. In the following description, the directions are specified based on a user who uses the laser printer 1. That is, in FIG. 1, the right side is called the "near sides", the left side is called the "back side", the back side in the perpendicular direction of the paper is called the "right side", and the near side in the perpendicular direction of the paper is called the "left side". In addition, since the up-down direction in the drawings is coincident with the up-down direction specified based on a user who uses the printer, the "up-down" direction is simply used. These directions are intended to facilitate understanding of the structure of the printer 1 and should not be interpreted in a restrictive sense.

(Entire Configuration of Laser Printer)

As shown in FIG. 1, the laser printer 1 includes a main casing 2, and a feeder portion 4 for feeding sheets 3 and an image forming portion 5 for forming images on a sheet 3, which are located inside the main casing 2.

(Configuration of Feeder Portion)

The feeder portion 4 includes a sheet feeding tray 6 removably mounted to the inner bottom of the main casing 2 and a sheet pressing plate 7 disposed inside the sheet feeding tray 6.

The feeder portion 4 has various rollers 11 for conveying sheets 3 and removing paper dust. The feeder portion 4 functions so that sheets 3 in the sheet feeding tray 6 are biased upward by the sheet pressing plate 7 and are conveyed to the image forming portion 5 by the rollers 11.

(Configuration of Image Forming Portion)

The image forming portion 5 includes a scanner unit 16, a process cartridge 17 and a fixing unit 18.

(Configuration of Scanner Unit)

The scanner unit 16 is disposed in the inner upper part of the main casing 2 and includes a laser beam emitting portion (not illustrated), a polygon mirror 19 driven to turn, lenses 20, 21, and reflection mirrors 22, 23 and 24. A laser beam passes thought the scanner unit 16 along a path shown by a chain line in FIG. 1 to be irradiated on the surface of a photosensitive drum 27 for scanning at high speed.

(Configuration of Process Cartridge)

The process cartridge 17 is removable from and mountable to the main casing 2 when a front cover 2*a* at the near side of the main casing 2 is open. The process cartridge 17 includes a development cartridge 28 as an example of a developing unit and a drum unit 39.

The development cartridge 28 is removable from and mountable to the main casing 2 in a state where the development cartridge 28 is mounted to the drum unit 39. Alternatively, the drum unit 39 may be fixed to the main casing 2, and the development cartridge 28 per se may be removably mountable to the drum unit 39 fixed to the main casing 2. As shown in FIG. 2, the development cartridge 28 includes a developing roller 31 as an example of a developer carrier, a layer thickness regulating blade 32 as an example of a layer thickness regulating member, a supply roller 33 and a developer accommodating chamber 34.

In the development cartridge 28, toner as an example of a developer in the developer accommodating chamber 34 is agitated by an agitator 34A and thereafter supplied to the developing roller 31 by the supply roller 33. When the toner is supplied to the developing roller 31 by the supply roller 33, the toner is positively friction-charged between the supply roller 33 and the developing roller 31. As the developing roller 31 rotates, the toner supplied onto the developing roller 31 enters between the layer thickness regulating blade 32 and the developing roller 31 so that the toner is further friction-charged while the toner on the developing roller 31 is regulated to a constant thickness. This way, a thin layer of the toner is carried on the developing roller 31. A detailed description will be given later of the development cartridge 28.

The drum unit 39 includes a photosensitive drum 27, a Scorotron type charger 29 and a transfer roller 30. The surface of the photosensitive drum 27 in this drum unit 39 is positively charged uniformly by the Scorotron type charger 29 and thereafter exposed by a high-speed scanning of the laser beam emitted from the scanner unit 16. Consequently, the potential at the exposed portion is lowered to form an electrostatic latent image based on image data.

As the developing roller 31 rotates, the toner carried on the developing roller 31 is supplied to the electrostatic latent image formed on the surface of the photosensitive drum 27 to form a toner image on the surface of the photosensitive drum 27. Thereafter, a sheet 3 is conveyed between the photosensitive drum 27 and the transfer roller 30 so that the toner image carried on the surface of the photosensitive drum 27 is transferred onto the sheet 3.

(Configuration of Fixing Part)

As shown in FIG. 1, the fixing unit 18 includes a heating roller 41 and a pressing roller 42 disposed opposite the heating roller 41 to press the heating roller 41. When the sheet 3 passes between the heating roller 41 and the pressing roller 42, toner transferred on the sheet 3 is thermally fixed to the sheet 3. The sheet 3 having the toner image thermally fixed by the fixing unit 18 is conveyed to a discharge roller 45 disposed at the downstream side of the fixing unit 18 to be fed out from the discharge roller 45 onto a discharge tray 46.

(Detailed Structure of Development Cartridge)

Figure 3A:
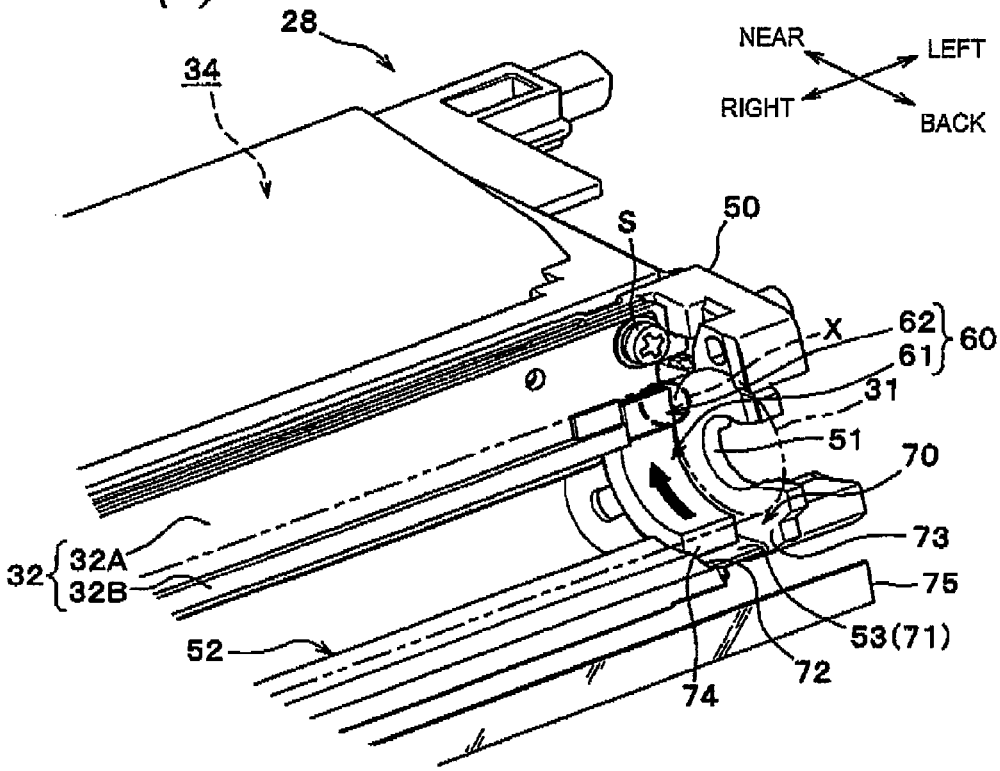
FIG. 3(*a*) is an enlarged perspective view showing a structure around a side sealing member, FIG. 3(*b*) is a sectional view showing details of the side sealing member, and FIG. 3(*c*) is an enlarged perspective view showing an X portion in FIG. 3(*a*).
Figure 3B:
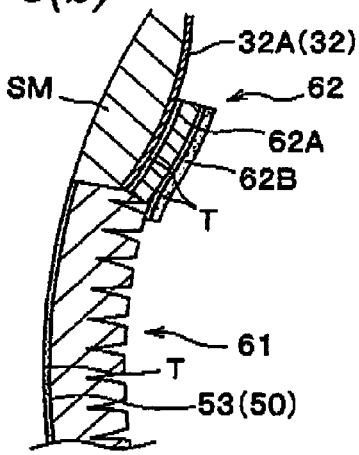
Figure 3C:
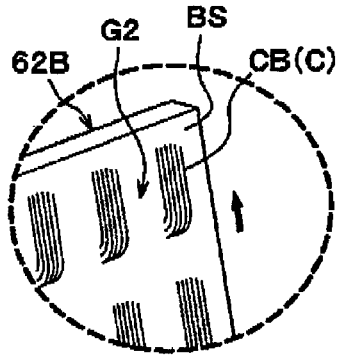
Figure 4:
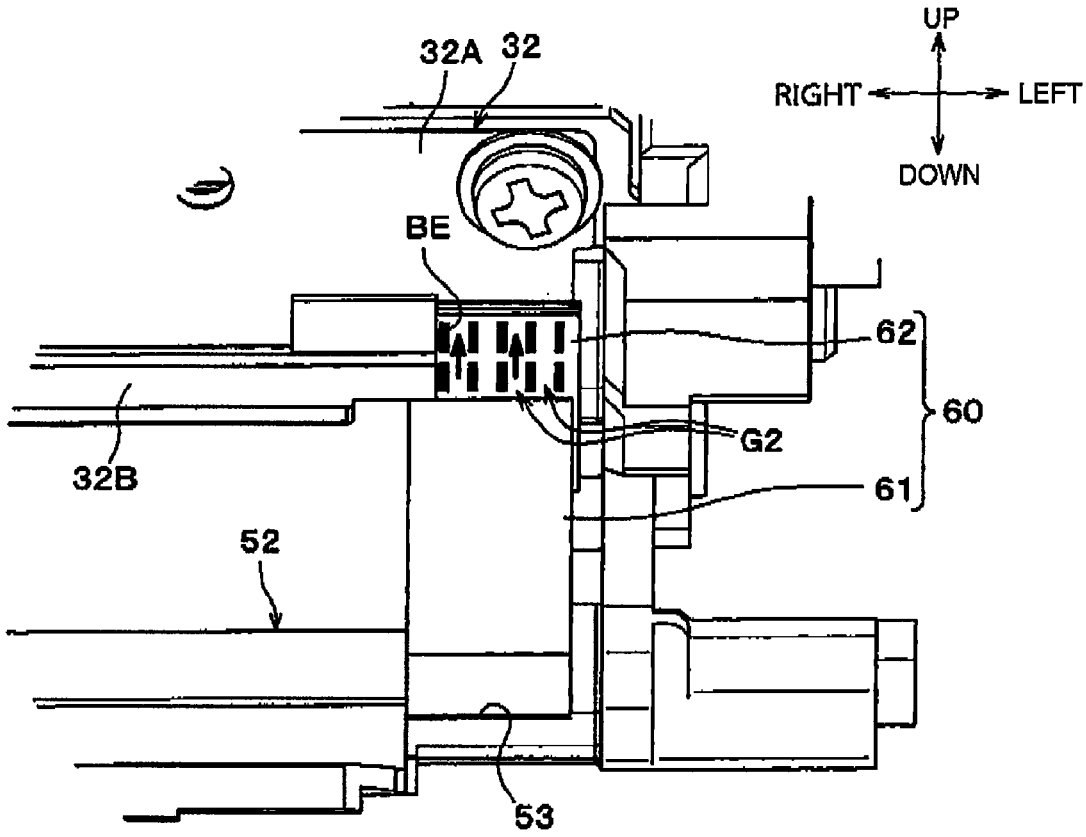
FIG. 4 is a front elevational view showing an upstream side seal and a downstream side seal.
Figure 5A:
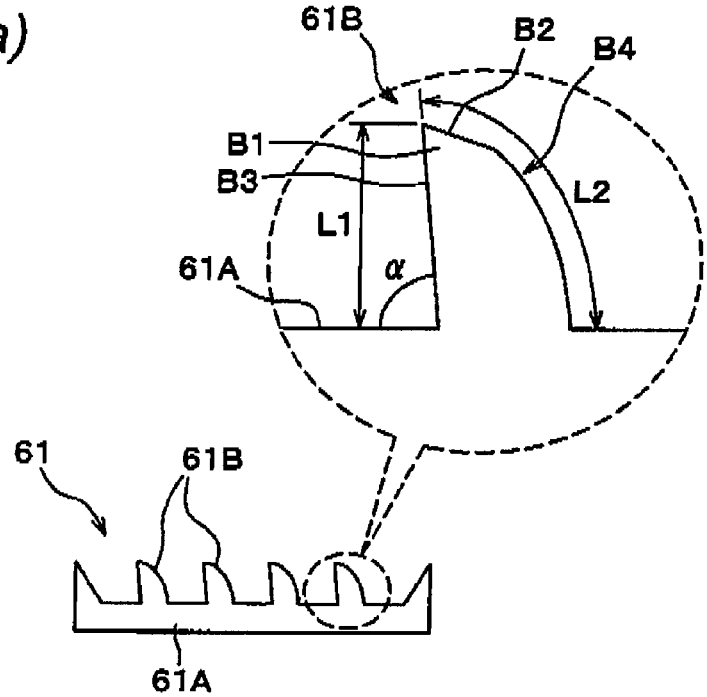
FIG. 5(*a*) is a front elevational view showing the upstream side seal, FIG. 5(*b*) is a side elevational view of the upstream side seal, and FIG. 5(*c*) is a plan view of the upstream side seal.
Figure 5B:
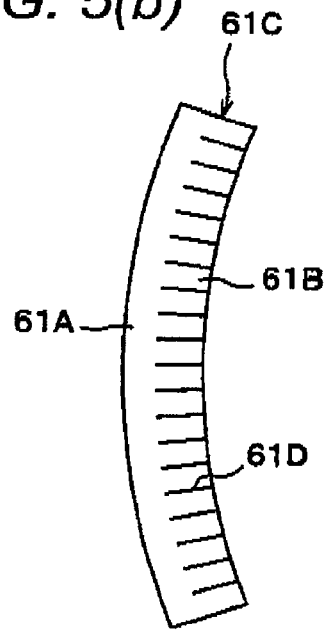
Figure 5C:
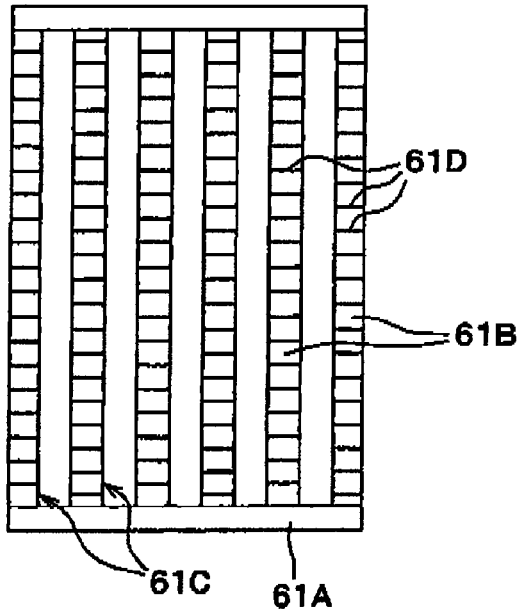
Figure 6A:
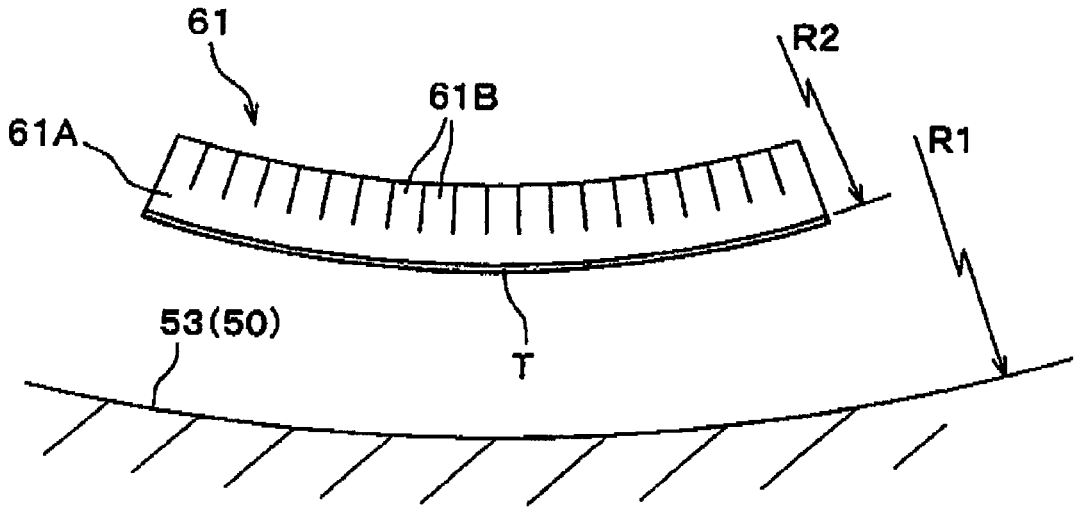
FIG. 6(*a*) is a side elevational view showing a state of the upstream side seal before the upstream side seal is attached to an attaching face of a developing unit housing, and FIG. 6(*b*) is a side elevational view showing a state of the upstream side seal after the upstream side seal is attached to the attaching face of a developing unit housing.
Figure 6B:
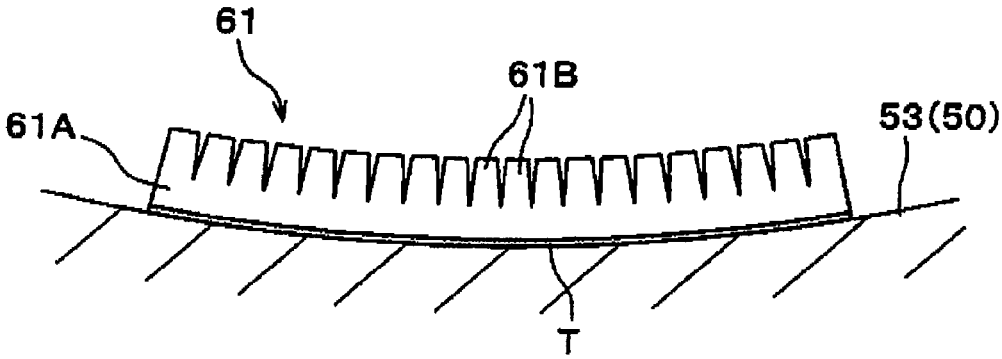

Next, a detailed description is given of the structure of the development cartridge 28. FIG. 3(*a*) is an enlarged perspective view showing the structure around a side sealing member, FIG. 3(*b*) is a sectional view showing the details of the side sealing member, and FIG. 3(*c*) is an enlarged perspective view of X portion in FIG. 3(*a*). FIG. 4 is a front elevational view showing an upstream side seal and a downstream side seal. FIG. 5(*a*) is a front elevational view showing the upstream side seal, FIG. 5(*b*) is a side elevational view of the upstream side seal, and FIG. 5(C) is a plan view of the upstream side seal. FIG. 6(*a*) is a side elevational view showing a state before the upstream side seal is attached to an attaching face of the developing unit housing, and FIG. 6(*b*) is a side elevational view showing a state after the upstream side seal is attached to the attaching face of the developing unit housing. Since the development cartridge 28 is of a left-right symmetrical structure, FIG. 3 and FIG. 4 show only the left side thereof with the right side thereof omitted. In addition, FIG. 3 and FIG. 4 show a state where the developing roller 31 and the supply roller 33 are removed, and the structure of the upstream side seal 61 is simplified for illustration.

As shown in FIG. 3(*a*), the development cartridge 28 includes a developing unit housing 50 that rotatably supports the developing roller 31, and a side sealing member 60 that is brought into sliding contact with corresponding one of end parts of the developing roller 31, in addition to the developing roller 31, etc. described above.

The developing unit housing 50 includes a bearing portion 51 that rotatably supports the developing roller 31, a supply port 52 for supplying toner from the internal toner accommodating chamber 34 to the developing roller 31, and an attaching face 53, the side view of which is arc-shaped. The attaching face 53 is disposed adjacent to each of left and right sides of the supply port 52 (the attaching face 53 disposed adjacent to the left side of the supply port 52 is only shown in FIG. 3(*a*)). The supply port 52 is in the form of a rectangular long hole elongating in the axial direction of the developing roller 31, and the layer thickness regulating blade 32 is fixed to the housing 50 at the upper part of the supply port 52.

The layer thickness regulating blade 32 includes a metal plate 32A the upper end part of which is fixed to the developing unit housing 50 and a rubber pressing member 32B, as an example of a pressing portion, fixed to the lower edge (distal end) of the metal plate 32A. The metal plate 32A has such a length as to protrude outside the left and right edges of the supply port 52 in the right-left direction, and the metal plate 32A is fixed at the upper side corner parts of left and right end parts thereof to the developing unit housing 50 with screws S. The pressing member 32B has such a length that the pressing member protrudes outside the left and right edges of the supply port 52 in the right-left direction but the left and right edges of the pressing member 32B are positioned inside the left and right edges of the metal plate 32A in the right-left direction (see FIG. 4). The pressing member 32B is brought into sliding contact with the outer circumferential surface of the developing roller 31, while receiving a basing force from the metal plate 32A.

The side sealing member 60 is disposed between corresponding one of the end parts of the developing roller 31 and corresponding one of the attaching faces 53 of the developing unit housing 50 adjacent to the left and right sides of the supply port 52 developing unit housing 50. The side sealing member 60 includes an upstream side seal 61 and a downstream side seal 62 as an example of the downstream side sealing portion.

The upstream side seal 61 is an elastic member made, for example, silicon rubber, and as shown in FIGS. 5(*a*) to 5(*c*), the upstream side seal 61 includes a sheet-like base part 61A and plural projections 61B protruding from the base part 61A toward the developing roller 31 and integral with the base part 61A.

As shown in FIG. 5(*b*), the base part 61A is arc-shaped as viewed in the axial direction of the developing roller 31. In detail, as shown in FIG. 6(*a*), the base part 61A is curved to have a curvature radius R2 that is smaller than the curvature radius R1 of the attaching face 53 of the developing unit housing 50. Therefore, since the base part 61A is adhered to the attaching face 53 in the order from the middle part of the base part 61A when the base part 61A is attached to the attaching face 53 with a double-side adhesive tape T, air hardly enters between the base part 61A and the attaching face 53, and therefore the base part 61A can be closely contacted with and adhered to the attaching face 53 without any wrinkles.

As shown in FIGS. 5(*b*) and 5(*c*), the projections 61B are formed such that plural ribs 61*c* extending in the rotational direction of the developing roller 31 are provided with plural cuts 61D extending in the axial direction of the developing roller 31 (in the direction intersecting the direction in which the ribs 61 extend). In detail, the ribs 61C are arranged at a constant interval in the axial direction of the developing roller 31 (in the direction intersecting the rotational direction of the developing roller 31), and the cuts 61D formed in two adjacent ribs 61C shift one from another in the rotational direction of the developing roller 31. Accordingly, as described later, the projections 61B can form first guide paths G1 (see FIG. 7(*c*)) obliquely passing from the outer end part, in the right-left direction, of the base part 61A to the inner end part thereof.

The projections 61B thus formed are closely contacted with one another in the rotational direction of the developing roller 31 as shown in FIG. 6(*b*) before the base part 61A is attached to the attaching face 53, and are separated one from another as shown in FIG. 6(*b*) after the base part 61A is attached to the attaching face 53. Accordingly, since a space can be formed between the adjacent projections 61B in the rotational direction of the developing roller 31, the first guide paths G1 (see FIG. 7(*c*)) can be appropriately formed by utilizing the spaces as described later.

As shown in FIG. 5(*a*), the distal end part B1 of the projection 61B has an inclination face B2 which inclines toward the supply port 52 of the developing unit housing 50 as it approaches the distal end. The projection 61B further has an inside face B3 that is positioned at an inner side (the supply port 52 side of the developing container housing 50) in the right-left direction and an outside face B4 that is positioned at an outer side (outside the inside face B3) in the right-left direction and that includes the inclination face B2. An angle $\alpha$ formed by the inside face B3 and the base part 61A is 90 degrees or less, and a length L1 from the proximal edge of the inside face B3 to the distal edge thereof is shorter than a length L2 from the proximal edge of the outside face B4 to the distal edge thereof.

As schematically shown in FIG. 4, the upstream side seal 61 thus constructed has a width larger than a width of the downstream side seal 62 in the right-left direction so that the upstream side seal 61 extends toward the supply port 52 beyond the downstream side seal 62.

As shown in FIG. 3(*b*), the downstream side seal 62 is disposed at the downstream side in the rotational direction of the developing roller 31 relative to the upstream side seal 61, and includes an elastic base 62A and a surface member 62B provided to a surface of the base 62A facing the developing roller 31. The base 62A is an elastic member formed, for example, of a urethane sponge, and adhered to the metal plate 32A of the layer thickness regulating blade 32 by a double-side adhesive tape T.

Herein, the "rotational direction" means the direction (the direction of the arrow in FIG. 3(*a*)) in which the developing roller 31 is brought into sliding contact with the upstream side seal 61.

The surface member 62B is constructed such that plural capillary members (fibrous members) C are implanted on a base sheet BS as shown in FIG. 3(*c*). In detail, the surface member 62B is constructed such that plural rows, each having capillary bundles CB arranged at an interval in the rotational direction of the developing roller 31 are arranged at an interval in the axial direction of the developing roller 31, and that the capillary bundles CB are tilted toward the downstream side in the rotational direction of the developing roller 31 (in the direction shown by the arrow in FIGS. 3(*a*), 3(*c*) and 4). Accordingly, the surface member 62B is configured to have the second guide paths G2 between the capillary bundles CB to supply toner toward the downstream side in the rotational direction.

As shown in FIG. 3(*b*), the surface member 62B is longer than the base 62A in the rotational direction so that the surface member 62B extends toward the upstream side beyond the base 62A in the rotational direction. The surface member 62B is adhered by a double-side adhesive tape T to extend across a boundary between the base 62A and the upstream side seal 61.

As shown in FIG. 4, the downstream side seal 62 (the base 62A and the surface member 62B) thus constructed is disposed on the layer thickness regulating blade 32 to be closely contacted with corresponding one of left and right edges BE (the left edge BE in FIG. 4) of the pressing member 32B of the layer thickness regulating blade 32. As shown in FIG. 3(*b*), another sealing material SM, which is different from the side sealing member 60, is disposed between the layer thickness regulating blade 32 (metal plate 32A) and the attaching face 53 of the developing unit housing 50.

As shown in FIG. 3(*a*), a recessed developer receiver 70 that is open only upward is formed at the upstream side of the upstream side seal 61. In detail, the developer receiver 70 is formed by a bottom wall part 71 (a part of the attaching face 53) of the housing 50, an inner wall part (right wall part in FIG. 3(*a*)) 72 of the housing 50, an outer wall part (left wall part in FIG. 3(*b*)) 73 of the housing 50, a back side (upstream side) end face 74 of the upstream side seal 61 and a flexible sheet member 75 attached to back side end parts of the bottom wall part 71, the inner wall part 72 and the outer wall part 73.

Figure 7A:
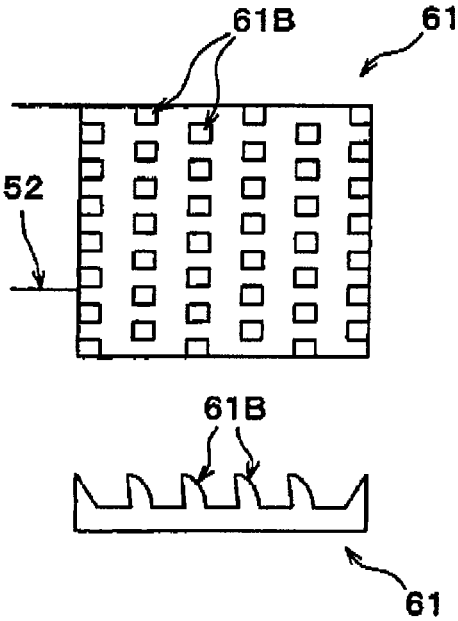
FIG. 7(*a*) is a schematic view showing the upstream side seal in a state where the upstream side seal is attached to the attaching face of the developing unit housing, FIG. 7(*b*) is a schematic view showing a state of projections of the upstream side seal when a developing roller is set in the developing unit housing, and FIG. 7(*c*) is a schematic view showing a state of the projections of the upstream side seal when the developing roller is rotated.
Figure 7B:
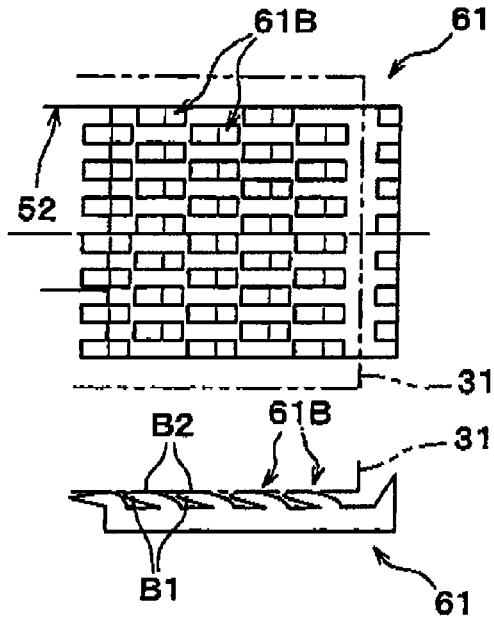
Figure 7C:
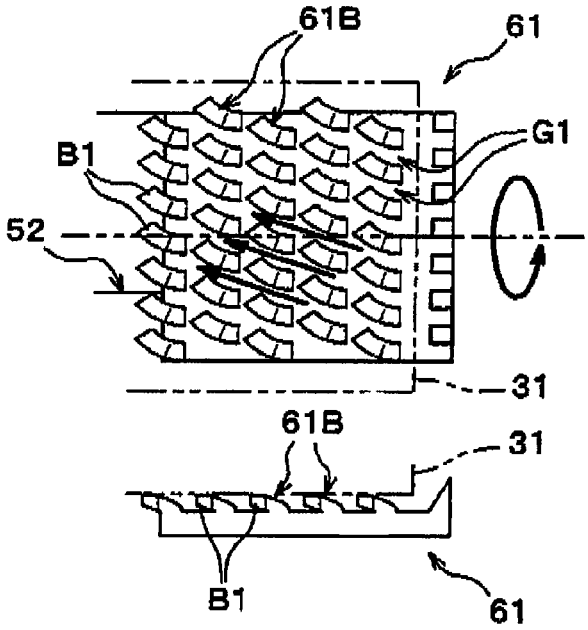

Next, a description is given of operation of the side sealing member 60. FIG. 7(*a*) is a schematic view showing the upstream side seal 61 in a state where it is attached to the attaching face 53 of the developing unit housing 50, FIG. 7(*b*) is a schematic view showing states of the projections 61B of the upstream side seal 61 when the developing roller 31 is set in the developing unit housing 50, and FIG. 7(*c*) is a schematic view showing states of the projections 61B of the upstream side seal 61 when the developing roller 31 is rotated. In FIGS. 7(*a*) to 7(*c*), the structure of the upstream side seal 61 is schematically illustrated, and in particular, intervals between the projections 61B in the rotational direction of the developing roller 31 are illustrated in an enlarged manner.

When the upstream side seal 61 is attached to the attaching face 58 of the developing unit housing 50 as shown in FIG. 3(*a*), the projections 61B are brought into a state where the projections 61B are separated in the axial direction of the developing roller 31 and the rotational direction thereof as shown in FIG. 7(*a*) because, as shown in FIG. 6(*b*), the projections 61B separate from each other.

When the developing roller 31 is set to the developing unit housing 50 in this state, the inclination faces B2 of the distal end parts B1 of the projections 61B are pressed by the developing roller 31 as shown in FIG. 7(*b*), so that the projections 61B tilt toward the supply port 52. When the developing roller 31 is rotated for printing action, etc., the distal end parts B1 of the projections 61B are pressed toward the downstream side in the rotational direction by the developing roller 31 as shown in FIG. 7(*c*). That is, the distal end parts B1 of the projections 61B are oriented in an oblique direction such that a portion of each distal end part B1, closer to the downstream side in the rotational direction, is closer to the supply port 52. Consequently, oblique first guide paths G1 are formed between the projections 61B. Accordingly, when toner enters the upstream side seal 61, the toner on the upstream side seal 61 is moved along the first guide paths G1 between the obliquely oriented projections 61B, and therefore the toner is moved toward the supply port 52 to be returned to the supply port 52.

When toner enters the downstream side seal 62 where the capillary bungles CB are tilted toward the downstream side in the rotational direction by rotation of the developing roller 31, the toner on the downstream side seal 62 is moved toward the downstream side along the second guide paths G2 between the capillary bundles CB (or along spaces between the capillary members C of the capillary bundles CB). Therefore, toner is carried by the developing roller 31 during the movement of the toner on the downstream side seal 62 toward the downstream side in the rotational direction, and therefore the toner is conveyed by the developing roller 31 to be returned to the upstream side seal 61. The toner returned to the upstream side seal 61 is obliquely moved on the upstream side seal 61 to be returned to the supply port 52 as described above.

Accordingly, the following effects can be obtained.

Since toner can be returned to the supply port 52 by the oblique first guide path G1 formed between the projections 61B of the upstream side seal 61, it is possible to prevent toner from leaking. In addition, the projections 61B preferably have such a length that a distal end of a projection 61B can contact a proximal end of an adjacent projection 61B. This can prevent toner from flowing out from one guide path G1 to an adjacent guide path G1, and thus can make flow of the toner smooth to further facilitate returning of toner to the supply port 52.

Since the upstream side seal 61 is constructed as a single (one-piece) elastic member, the attaching work can be completed by simply attaching the upstream side seal 61 to the developing unit housing 50. Accordingly, it is possible to dispense with an additional work that a base and a felt member are adhered, and therefore the attaching work can be facilitated.

Since the angle between the inside face BS of the projection 61B and the base part 61A is 90 degrees or less, and the length L1 from the proximal edge of the inside face B3 to the distal edge thereof is shorter than the length L2 from the proximal edge of the outside face B4 of the projection 61B to the distal edge thereof, the projection 61B can surely tilt toward the supply port 52.

Since the projections 61B are formed by providing plural ribs 61C with plural cuts 61D, the shape of a mold for molding the upstream side seal 61 can be simplified, and injection molding can be carried out easily.

Since the downstream side seal 62 is configured to feed toner toward the downstream side in the rotational direction of the developing roller 31, the toner on the downstream side seal 62 can be returned to the supply port 52 via the developing roller 31 and the upstream side seal 61, therefore leakage of toner can be prevented more securely.

Since the downstream side seal 62 is closely contacted with the edge BE of the pressing member 32B of the layer thickness regulating blade 32 in the right-left direction, it is possible to prevent toner from leaking therebetween.

Since the upstream side seal 61 extends toward the supply port 52 beyond the downstream side seal 62, it is possible to prevent toner from flowing from the supply port 52 to a boundary between the edge BE of the pressing member 32B and the downstream side seal 62 by the extended portion of the upstream side seal 61 beyond the downstream side seal 62.

Since the recessed developer receiver 70 is formed at the upstream side of the upstream side seal 61, the developer receiver 70 can receive toner even in a case where toner conveyed from the downstream side seal 62 by the developing roller 31 is scraped and dropped by the edge of the upstream side seal 61. Therefore, it is possible to prevent toner from leaking from the development cartridge 28.

Since the comparatively wide second guide path G2 can be formed between the capillary bundles CB tilted in a certain direction, toner can be smoothly sent in that direction. In addition, the capillary bundles CB preferably have such a length that a tip of a capillary bundle CB can contact a root portion of an adjacent capillary bundle CB. This is because toner can be prevented from flowing out from one guide path G2 to an adjacent guide path G2, and thus the flow of toner can be smoothened.

The present invention is not limited to the above-described exemplary embodiment and can be embodied in various ways including, for example, the following modifications.

Figure 8:
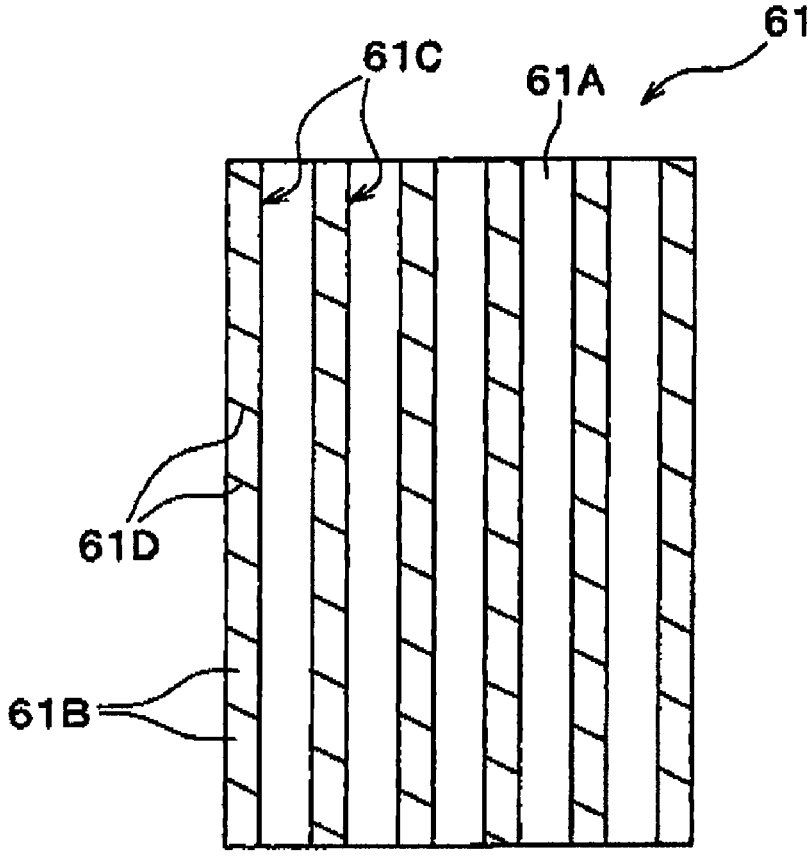
FIG. 8 is a plan view showing a modification of the upstream side seal.

In the embodiment, although the cuts 61D extend in the axial direction of the developing roller 31, the present invention is not limited thereto. For example, as shown in FIG. 8, the cuts 61D may extend in such an oblique direction that a portion of the cuts 61D, closer to the downstream side in the rotational direction of the developing roller 31, is closer to the supply port 52. According to this arrangement, since the projections 61B can tilt in the direction of the cuts 61D when the developing roller 31 is set in the developing unit housing 50, it is possible to further reliably make the projections 61B tilt in the oblique direction. In this case, it is preferable that the cuts 61D in the adjacent ribs 61C are linearly arranged. This is because oblique guide paths, each extending from the outer end part, in the right-left direction, of the base part 61A to the inner end thereof, can be formed by and between the projections 61B.

Figure 9:
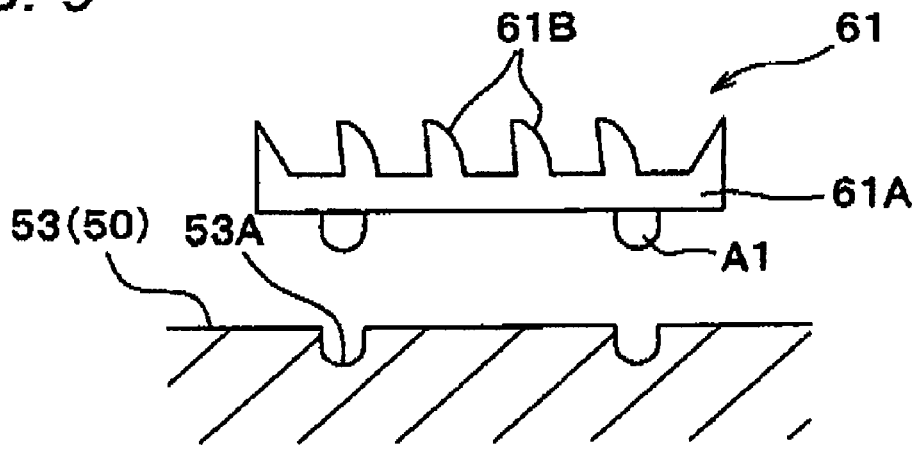
FIG. 9 is a side elevational view showing a modification in which engagement projections are provided to the upstream side seal and engagement holes are provided to the attaching face of the developing unit housing.

In the above-described embodiment, the upstream side seal 61 is adhered to the attaching face 53 of the developing unit housing 50 by the double-side adhesive tape T. However, the present invention is not limited thereto. The upstream side seal 61 may be adhered thereto with an adhesive agent, etc. Alternatively, for example, as shown in FIG. 9, an engagement projection A1 as an example of a seal side engagement portion may be formed on the lower surface of the base part 61A of the upstream side seal 61, an engagement hole 53A as an example of a housing side engagement portion, which is engageable with the engagement projection A1, may be formed on the attaching face 53 of the developing unit housing 50, and the upstream side seal 61 may be attached to the attaching face 53 by engagement (fitting) of these portions A1 and 53A. Alternatively, the seal side engagement portion is formed as a hole, and the housing side engagement portion may be formed as a projection.

In the embodiment, a downstream side seal 62 discrete from the upstream side seal 61 is adopted as the downstream side sealing portion. However, the present invention is not limited thereto. For example, an extension portion may be additionally provided to the upstream side seal 61 of the aforementioned embodiment to extend from the downstream side end part of the upstream side seal 61 of the aforementioned embodiment toward the downstream side in the rotational direction, and plural projections that can tilt toward the downstream side in the turning direction may be formed on the extension portion. That is, the extension portion of the upstream side seal may function as the downstream side sealing portion.

In the embodiment, the capillary bundles CB on the downstream side seal 62 are tilted toward the downstream side in the rotational direction (herein merely called "downstream side") to feed toner toward the downstream side. However, the present invention is not limited thereto. For example, plural rows, each having capillary bundles standing upright from the base sheet and being arranged closely to one another in the rotational direction, may be provided to feed toner toward the downstream side. Alternatively, such a woven fabric that yarns exposed therefrom to the developing roller 31 are oriented in the rotational direction may be used to feed toner toward the downstream side. Alternatively, in place of capillary bundles CB, plural capillary members may be densely arranged on the entire surface of the base sheet to tilt toward the downstream side, to thereby feed toner along the capillary members. In addition, the downstream side seal is not necessarily configured to convey toner toward the downstream side, and for example, a felt member in which fibers are not unidirectional may be adopted as the downstream side seal.

In the embodiment, the downstream side seal 62 is adhered to the metal plate 32A of the layer thickness regulating blade 32. However, the present invention is not limited thereto. For example, in a case where the metal plate 32A of the layer thickness regulating blade 32 has the same dimension as the pressing member 32B in the right-left direction, the downstream side seal 62 may be adhered directly to the developing unit housing 50.

In the embodiment, the development cartridge 28 integrally provided with the toner accommodating chamber 34 is adopted as an example of the developing unit. However, the present invention is not limited thereto. A cartridge to which a separate toner cartridge having a toner accommodating chamber is removably mountable may be adopted as the developing unit.

As discussed above, the present invention can provide at least the following illustrative, non-limiting embodiment:

(1) A developing unit including: a developer carrier for carrying a developer; a developing unit housing that rotatably supports the developer carrier and that has a supply port for supplying the developer to the developer carrier; a side sealing member that is disposed between one of end parts of the developer carrier and a portion of the developing unit housing adjacent to the supply port and that is brought into sliding contactable with the developer carrier, wherein the side sealing member is an elastic member having an integral base part closely attached to the developing unit housing and plural projections protruding from the base part toward the developer carrier; and an inclination face at a distal end part of the projection is inclined so that a part of the inclination face is closer to the supply port as the part of the inclination face is farther from the base part in an protruding direction.

According to the developing unit of (1), the side sealing member is attached to the portion of the housing adjacent to the supply portion and thereafter a developer carrier is set in the developing unit housing to press the inclination face of the distal end part of the projection to thereby incline the projection toward the supply port. When the developer carrier is rotated for printing action, etc., the developer carrier presses the distal end part of the projection toward the downstream side in the rotational direction to orient the distal end part of the projection in an oblique direction such that a part of the distal end part, closer to the downstream side in the rotational direction, is closer to the supply port. This forms an oblique flow path between the projections to return a developer to the supply port. Accordingly, the developer can be prevented from leaking. Since the side sealing member is constructed as a single elastic member, the attaching work can be completed by simply attaching the side sealing member to the developing unit housing, and therefore the attaching work can be facilitated.

What is claimed is:

1. A developing unit comprising:

a developer carrier configured to carry a developer, the developer carrier having axial end parts;

a housing that rotatably supports the developer carrier and that has a supply port through which the developer can be supplied to the developer carrier; and a side sealing member that is disposed between one of the axial end parts of the developer carrier and a portion of the housing adjacent to the supply port and that is configured to be slidingly contactable with the developer carrier;

wherein the side sealing member includes an elastic member having an integral base part closely attached to the portion of the housing and plural integral projections protruding from the base part toward the developer carrier in a protruding direction; and wherein a distal end part of each of the projection has an inclination face inclined so that a part of the inclination face is closer to the supply port as the part of the inclination face is farther from the base part in the protruding direction;

wherein the side sealing member has a downstream side portion located downstream in a rotational direction of the developer carrier, and a downstream side sealing portion is provided to the downstream side portion of the side sealing member to feed the developer toward a downstream side in the rotational direction.

2. The developing unit according to claim 1, wherein the projection has an inside face and an outside face that is opposite from the supply portion with respect to the inside face and that includes the inclination face, and a length from a proximal edge of the inside face to a distal edge thereof is shorter than a length from a proximal edge of the outside face to a distal edge thereof.

3. The developing unit according to claim 1, wherein the projections include: plural ribs that extend in a rotational direction of the developer carrier and that are arranged at an interval in a direction intersecting the rotational direction; and plural cuts that are provided to the ribs and that extend in a direction intersecting a direction in which the ribs extend.

4. The developing unit according to claim 3, wherein each of the cuts extends in an oblique direction so that a portion of each cut, closer to a downstream side in the rotational direction, is closer to the supply port.

5. The developing unit according to claim 1, wherein the portion of the housing includes a housing side engagement portion, and the base part of the side sealing member has a seal side engagement portion engaged with the housing side engagement portion.

6. The developing unit according to claim 1, further comprising:

a layer thickness regulating member that is disposed on the housing and that is configured to regulate a thickness of the developer carried on the developer carrier, wherein the downstream side sealing portion is contacted with a side edge of the layer thickness regulating member in an axial direction of the developer carrier, and the side sealing member extends beyond a boundary between the downstream side sealing portion and the side edge of the layer thickness regulating member in the axial direction.

* * * * *